US005642589A

United States Patent [19]

Miron et al.

[11] Patent Number: 5,642,589

[45] Date of Patent: Jul. 1, 1997

[54] COLUMN STRUCTURE FOR BEARING A PORTABLE STAGE ROOF

[75] Inventors: Yvan Miron, Montreal; Daniel Toutant, St-Martyrs-Canadiens; Marius Chouinard, Montreal, all of Canada

[73] Assignee: Canada Inc., Montreal, Canada

[21] Appl. No.: 614,083

[22] Filed: Mar. 12, 1996

Related U.S. Application Data

[63] Continuation of Ser. No. 264,782, Jun. 23, 1994, abandoned.

[51] Int. Cl.[6] ..... E04H 3/26; B66C 23/06

[52] U.S. Cl. ..... 52/7; 52/66; 52/118

[58] Field of Search ..... 52/7

[56] References Cited

U.S. PATENT DOCUMENTS

| | | | |
|---|---|---|---|
| 3,266,051 | 8/1966 | Attwood | 52/632 |
| 4,357,785 | 11/1982 | Eklund | 52/118 X |
| 4,513,938 | 4/1985 | Seymour | 52/118 X |
| 4,783,934 | 11/1988 | Langhart et al. | 52/126.1 X |
| 5,078,442 | 1/1992 | Rau et al. | 296/26 |
| 5,142,838 | 9/1992 | Simpson et al. | 52/66 X |
| 5,152,109 | 10/1992 | Boers | 52/143 |
| 5,319,895 | 6/1994 | Ray | 52/126.5 X |
| 5,327,698 | 7/1994 | Uhl | 52/66 X |
| 5,365,704 | 11/1994 | Ray | 52/126.5 X |

FOREIGN PATENT DOCUMENTS

| | | | |
|---|---|---|---|
| 904530 | 7/1972 | Canada | 52/632 |
| 2555820 | 5/1985 | France | 52/118 |
| 3611810 | 8/1986 | Netherlands | 52/118 |
| 4001806 | 7/1991 | Netherlands | 52/126.1 |

*Primary Examiner*—Carl D. Friedman
*Assistant Examiner*—Yvonne Horton-Richardson
*Attorney, Agent, or Firm*—Merchant, Gould, Smith, Edell, Welter & Schmidt, P.A.

[57] ABSTRACT

The telescopic column is provided for a portable stage used in outdoor or indoor events produced in front of audiences or the like and comprising a haulable chassis for overland transportation between events. The column bears a roof movable vertically above the chassis and comprises a plurality of C-shaped beams operatively fitted into each other and concentric with a central beam. A plurality of pairs of upper rollers, each operatively connected to an upper end of a corresponding C-shaped beam, are provided for engagement with the surface of an adjacent interior beam and for rolling thereon upon raising or lowering of the roof. The use of rollers prevents jamming of the C-shaped beams when moving the roof vertically.

3 Claims, 3 Drawing Sheets

COLUMN STRUCTURE FOR BEARING A PORTABLE STAGE ROOF

This is a File Wrapper Continuation application of application Ser. No. 08/264,782, filed Jun. 23, 1994 now abandoned.

FIELD OF THE INVENTION

The present invention relates to portable stages used for outdoor or indoor events produced in front of audiences or the like and comprising a haulable chassis for overland transportation between events. More particularly, the present invention relates to a telescopic column for a portable stage roof and to a corresponding column structure for bearing the roof.

BACKGROUND OF THE INVENTION

Portable stages comprising about all structural elements on a single chassis and that can be hauled by a vehicle when stowed are a very suitable alternative for static stages or temporary stages that need to be constructed by skilled workers. Such portable stages are generally mounted on a chassis having ground engaged wheels for overland transportation. Once on site, the portable stage is set very rapidly by a limited crew in outdoor or indoor locations, such as parks, stadiums, etc.

The portable stages usually comprise columns for supporting a movable roof. These columns are often telescopic and comprise a plurality of concentric beams slidable relative to each other. One particular problem with such telescopic columns is that a slight uneven weight distribution may off centered beams and jam the movement thereof relative to each other, especially when the roof is lowered. The beams will then have to be realigned perfectly for ensuring proper sliding and this may be very much time consuming.

SUMMARY OF THE INVENTION

The object of the present invention is to resolve the jamming problem of telescopic columns for portable stages by providing rollers ensuring a proper alignment of the beams.

More particularly, the object of the present invention is to provide a telescopic column for a portable stage roof movable vertically above a chassis, the column comprising:

- a substantially vertical central beam connectable to the roof;
- a plurality of C-shaped beams operatively fitted into each other and concentric with the central beam, each C-shaped beam having a slotted side aligned with the slotted side of the other C-shaped beams; and
- a plurality of pairs of upper rollers, each pair of upper rollers being operatively connected to an upper end of a corresponding C-shaped beam, each upper roller of a pair being connected to opposite sides of the corresponding C-shaped beam and engaged with an adjacent interior beam for rolling thereon upon raising or lowering of the roof.

It is also an object of the present invention to provide a column structure for bearing a portable stage roof movable vertically above a chassis, the system comprising:

- two opposite pairs of telescopic columns located between the roof and the chassis, each column comprising:
  - a substantially vertical central beam connected to the roof;
  - a plurality of C-shaped beams operatively fitted into each other and concentric with the central beam, each C-shaped beam having a slotted side aligned with the slotted side of the other C-shaped beams; and
  - a plurality of pairs of upper rollers, each pair of upper rollers being operatively connected to an upper end of a corresponding C-shaped beam, each upper roller of a pair being connected to opposite sides of the corresponding C-shaped beam and engaged with an adjacent interior beam for rolling thereon upon raising or lowering of the roof.

A non restrictive description of a preferred embodiment will now be given with reference to the appended drawings.

DESCRIPTION OF A PREFERRED EMBODIMENT

Figure 1:
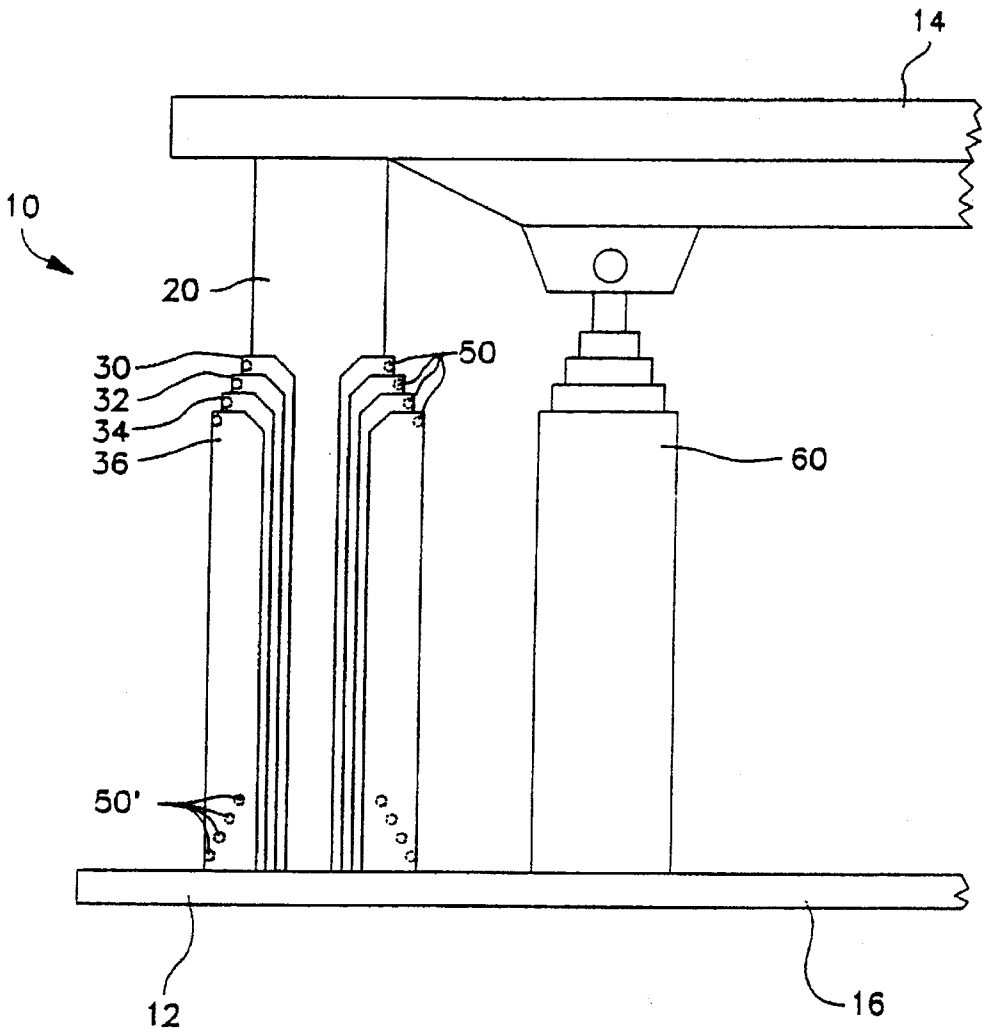
FIG. 1 is a side elevational view of the telescopic column and a hydraulic jack according to the present invention.

Referring to FIG. 1, there is shown a telescopic column 10 used in a portable stage 12 for supporting a roof 14 movable vertically above a chassis 16. The chassis 16 is mounted on ground engaged wheels (not shown) for overland transportation and is haulable by a truck or the like.

The column 10 comprises a substantially vertical central beam 20 welded or otherwise connected to the roof 14. Preferably, the central beam 20 has a square cross-section.

A plurality of C-shaped beams, respectively numbered 30, 32, 34 and 36, are operatively fitted into each other and concentric with the central beam 20 for allowing relative movement between each other. Each C-shaped beam has a slotted side 40 aligned with the slotted sides of the other C-shaped beams. The C-shaped beams are projecting substantially vertically over the chassis 16 and the C-shaped beam 36 is welded or otherwise connected to the chassis 16.

The column 10 comprises a plurality of pairs of upper rollers 50 for guiding the C-shaped beams during the relative movement thereof. One particularly important advantage of the rollers 50 is that jamming of the beams resulting from an imperfect weight distribution is substantially prevented.

Figure 2:
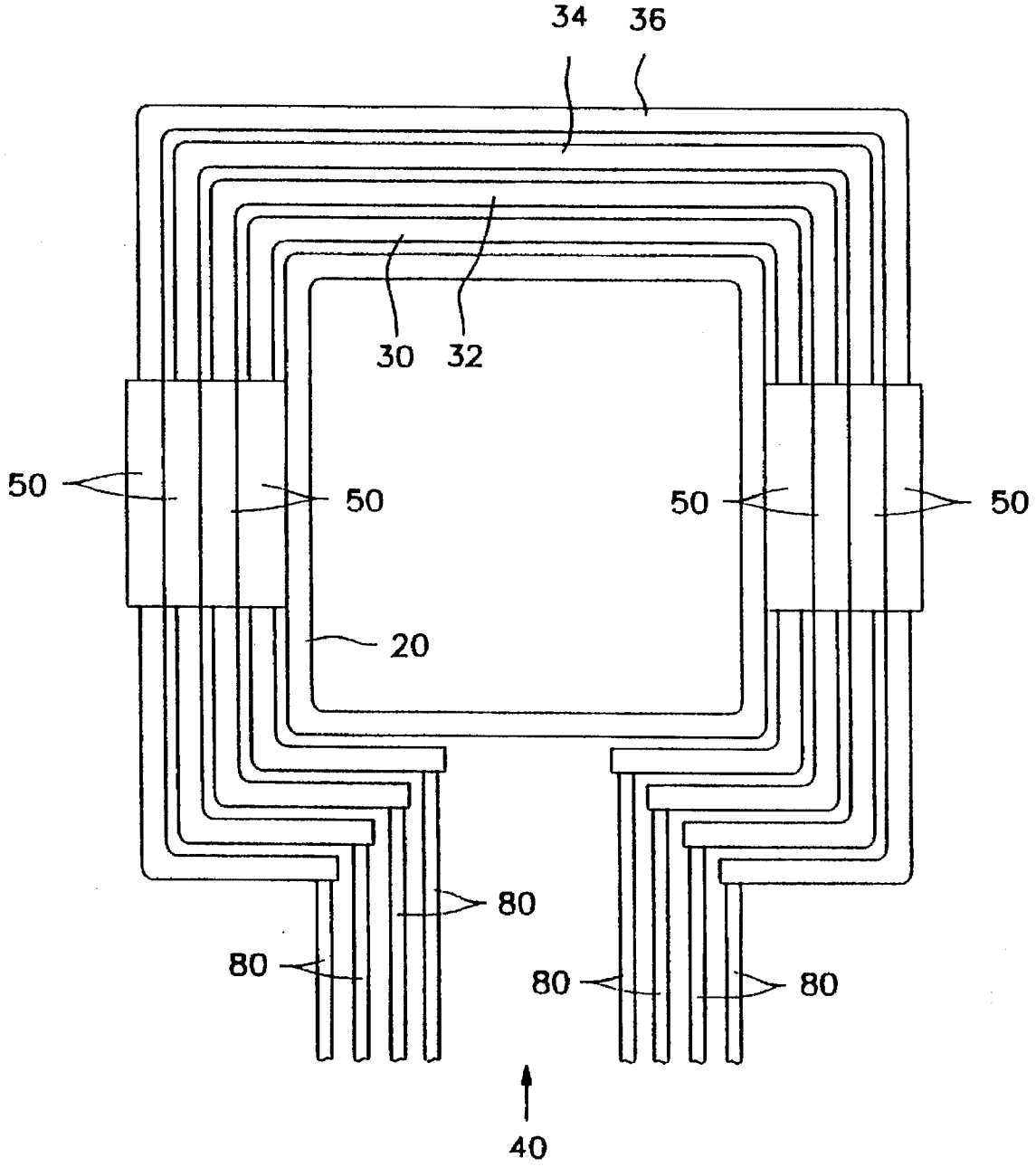
FIG. 2 is an upper view of the telescopic column of FIG. 1.
Figure 3:
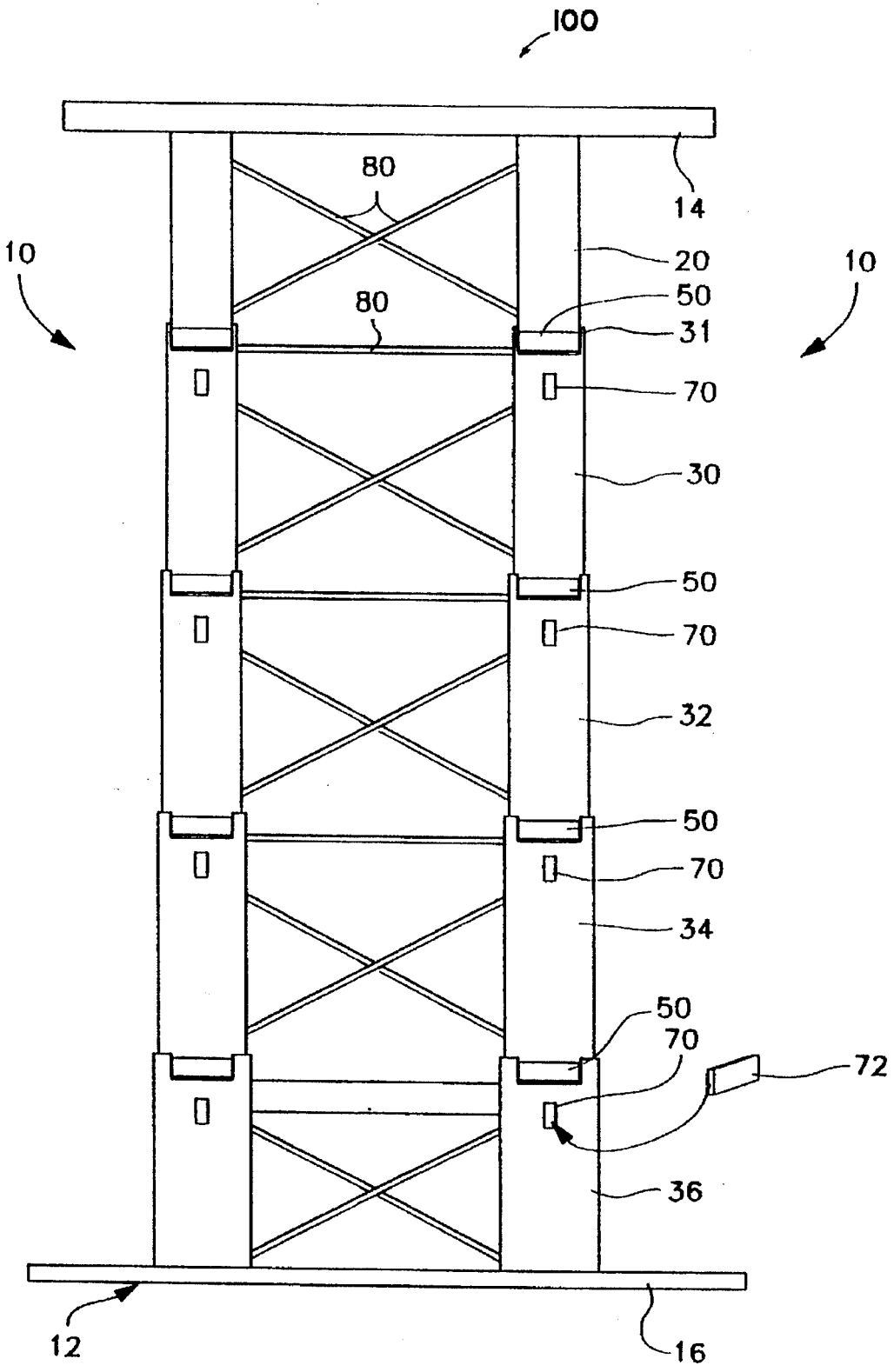
FIG. 3 is a lateral view of a column structure with a pair of telescopic columns according to the present invention.

Each pair of rollers 50 is operatively connected to an upper end of a corresponding C-shaped beam. As shown in FIG. 2, each roller 50 of a pair is connected to opposite sides of the corresponding C-shaped beam and engaged with the side surface of an adjacent interior beam for rolling thereon upon raising or lowering of the roof 14. For the C-shaped beam 30, the adjacent interior beam is the central beam 20. As shown in FIG. 3, the rollers 50 are located in a rectangular cutout 31 and maintained in place by a pivot axis (not shown).

As shown in FIG. 1, the C-shaped beams may comprise pairs of rollers 50' at the lower end thereof. Like the rollers 50, each roller 50' of a pair is connected to opposite sides of the corresponding C-shaped beam and engaged with the side surface of an adjacent interior beam for rolling thereon upon raising or lowering of the roof 14.

Although the roof 14 may be moved by an external device, such as a crane or the like, the column 10 is preferably provided with means for vertically moving the roof 14 above the chassis 16. A telescopic hydraulic jack 60 as shown in FIG. 1 is an example of such means. The jack 60 is perpendicularly connected to the roof 14 and to the chassis 16.

As shown in FIG. 3, each C-shaped beam is provided with a side-to-side aperture 70 to be aligned with a corresponding side-to-side aperture of the adjacent interior beam for receiving a locking member 72. The locking member 72 is a safety device for solidifying the structure.

When the roof 14 is rose, the central beam 20 initially slides out of the C-shaped beam 30 until a stop (not shown) prevents a further relative movement therewith. At that moment, the lower aperture of the central beam 20 is aligned with the upper aperture 70 of the C-shaped beam 30 and the locking member 72 may be inserted therein. This procedure is also carried out for the other beams until the roof 14 reaches a suitable height or is fully raised.

Referring again to FIG. 3, there is shown one half of a column structure 100 comprising a pair of telescopic columns 10 located between the roof 14 and the chassis 16. The column structure 100 has two opposite pairs of columns 10, each generally located on the front and the aft of the chassis 16 because the platforms of a portable stage are usually opened laterally. The other pair of columns 10 is identical to the one shown in FIG. 3. In such arrangement, the slotted side of a column 10 is facing the slotted side of the other column 10 of the same pair. Horizontal and diagonal transverse members 80 are provided for connecting both columns 10 together. Each member 80 has one end connected to a respective C-shaped beam and another end connected to the corresponding C-shaped beam of the other column 10 of a same pair for building of a very solid structure. The members 80 are stowed easily since they are connected to the free ends of the C-shaped beams and that each slotted side has a different width as shown in FIG. 2.

Although a preferred embodiment of the invention has been described in detail herein and illustrated in the accompanying drawings, it is to be understood that the invention is not limited to this precise embodiment and that various changes and modifications may be effected therein without departing from the scope or spirit of the invention.

What is claimed is:

1. A column structure for bearing a portable stage roof movable vertically above a chassis, the column structure comprising:

two opposite pairs of telescopic columns located between the roof and the chassis, each column comprising:

a substantially vertical central beam connected to the roof;

a plurality of C-shaped beams operatively fitted into each other and concentric with the central beam, each C-shaped beam having a slotted side aligned with the slotted side of the other C-shaped beams, the slotted sides of the column facing the slotted sides of the other column of the same pair; and a plurality of pairs of upper rollers, each pair of upper rollers being operatively connected to an upper end of a corresponding C-shaped beam, each upper roller of a pair being connected to opposite sides of the corresponding C-shaped beam and engaged with an adjacent interior beam for rolling thereon upon raising or lowering of the roof; and transverse members, each having one end connected to a respective C-shaped beam of one respective column and another end connected to the corresponding C-shaped beam of the other column of a same pair.

2. A column structure according to claim 1, wherein the central beam has a square cross-section.

3. A column structure according to claim 1, wherein each C-shaped beam is provided with an upper side-to-side aperture to be aligned with a corresponding lower side-to-side aperture of the adjacent interior C-shaped beam for receiving a locking member.

* * * * *

UNITED STATES PATENT AND TRADEMARK OFFICE
CERTIFICATE OF CORRECTION

PATENT NO. : 5,642,589

DATED : July 1, 1997

INVENTOR(S) : Miron et al.

It is certified that error appears in the above-identified patent and that said Letters Patent is hereby corrected as shown below:

Title page, item [73], Assignee [73]: "Canada Inc." should read --3101908 Canada Inc.--

Signed and Sealed this

Third Day of March, 1998

*Attest:*

Bruce Lehman

BRUCE LEHMAN

*Attesting Officer*

*Commissioner of Patents and Trademarks*